US005690783A

United States Patent [19]

Meyers et al.

[11] Patent Number: 5,690,783

[45] Date of Patent: Nov. 25, 1997

[54] MECHANISM FOR REPOSITIONING LABEL APPLICATOR HEAD BEFORE APPLYING LABEL TO INTERIOR OF CARTON

[75] Inventors: William J. Meyers, Clarence Center; Alex Saveliev, Rochester, both of N.Y.

[73] Assignee: Eastman Kodak Company, Rochester, N.Y.

[21] Appl. No.: 784,170

[22] Filed: Jan. 15, 1997

[51] Int. Cl.[6] ..... B65C 9/00

[52] U.S. Cl. ..... 156/566; 156/423; 156/542; 156/571; 156/572

[58] Field of Search ..... 156/566, 572, 156/571, 542, 423, DIG. 4, DIG. 38, 293, DIG. 31; 264/509

[56] References Cited

U.S. PATENT DOCUMENTS

| | | | |
|---|---|---|---|
| Re. 23,668 | 6/1953 | Von Hofe | 156/423 |
| 2,707,915 | 5/1955 | Nefzger | 156/572 X |
| 3,093,528 | 6/1963 | Reich | 156/285 |
| 3,729,362 | 4/1973 | French et al. | 156/542 |
| 4,024,011 | 5/1977 | Crankshaw et al. | 156/299 |
| 4,549,863 | 10/1985 | Bourgeois | 264/509 X |
| 4,708,630 | 11/1987 | Hammond | 264/509 X |
| 4,725,327 | 2/1988 | Matuda et al. | 156/351 |
| 4,919,747 | 4/1990 | Eagle | 156/571 X |
| 5,067,890 | 11/1991 | Dunlap et al. | 425/504 |
| 5,198,247 | 3/1993 | Bartimes et al. | 425/503 |
| 5,266,149 | 11/1993 | Collette et al. | 156/571 |

*Primary Examiner*—James Engel
*Attorney, Agent, or Firm*—Arthur H. Rosenstein

[57] ABSTRACT

A method for reorienting labels prior to their application, comprises moving containers through a packaging process, picking up labels with vacuum applicator heads, moving the labels by a translator mechanism to the containers at the same speed as that of the moving containers and simultaneously rotating applicator heads 90° by means of a rack and pinion gear drive and stationary cam, entering the container where the labels are blown off the vacuum grid on the applicator heads and onto the inside of the containers and returning to the first position and continuously repeating the process.

4 Claims, 8 Drawing Sheets

MECHANISM FOR REPOSITIONING LABEL APPLICATOR HEAD BEFORE APPLYING LABEL TO INTERIOR OF CARTON

FIELD OF THE INVENTION

This invention relates to a label reorientation device. More particularly, the invention relates to a label applicator mechanism which incorporates a cam actuated rotational member for the vacuum applicator head.

BACKGROUND OF THE INVENTION

Label applicators typically apply labels to articles as the articles are conveyed past the label applicator. Usually, the labels are releasably adhered, in a single column, to an elongated backing strip. The label applicator removes one of the labels from the backing strip and releasably retains it at a labeling station. As the articles to be labeled move near the removed label, it is applied to the articles. Label applicators of this type are shown, for example, in U.S. Pat. Nos. 3,093,528; 3,729,362; and 4,024,011.

Label applicators of this type, while satisfactory for many applications can introduce delay into an assembly or packaging operation in which labeling must be carried out. For example, label indexing or advancement; i.e., the removal of a label from a backing strip, applying it to a suitable retaining means, and then rotating the label in another distinct operation is relatively slow while the transfer of a retained label to the article can be rapidly carried out. Sequencing of label motions can be sufficiently slow so that the labeling function is the slowest operation on the production line.

Other work operations also involve the repetitive supply of elements to a work station so that such elements can be affixed, assembled, laminated, etc., to articles being conveyed through the work station. In some of the work operations, the repetitive supply of the elements is the slowest step in the process, and accordingly, this limits the speed with which the articles can be conveyed through the work station. Thus, other work operations involve problems similar to the label application problem described above.

An additional problem in the high speed labeling of articles is to provide labels containing unique information for each individual package, such as weight, product size, a bar code, or a product identification number.

Most labels are applied directly on the outside of the container using direct applications to apply the label to the outside of the carton or container for the goods sold. However, in many applications, for instance in the sale of consumer goods such a photographic film and like materials to be sold in department stores or discount stores where shoplifting is a major problem, the labels that are adhered to the cartons are treated either electrically or magnetically to register that the carton has been paid for before it left the premises. Thus, counter salespeople will deactivate the labels as they are paid for so that a store's detectors will not be activated in order to prevent theft.

The problem with these labels is that they are still susceptible to theft. In many cases, the labels on the outside of the container can be removed or switched prior to its reaching the cash register. Because of this problem, many department stores and other retailers are asking manufacturers of these goods to put the labels in the inside of the carton or container so they can be read accurately and the label can not be tampered with. This represents a major problem for manufacturers, it is very inconvenient to apply labels to the inside of a carton. To use the processes described above that are used to apply the labels to the outside of the containers will require tedious apparatus and extreme difficulty applying to the inside of containers. It would be very difficult to do so without stopping or, at least substantially slowing down the packaging process. This results in much higher costs for the product to be sold.

The use of a label applying apparatus to the processing system which can be done expeditiously and at high speeds while applying the labels to the inside of containers without holding up or slowing down the packaging process has been described in U.S. application Ser. No. 08/710,800, filed 23 Sep. 1996 by Meyers et at.

The labeling station must rotate to a new orientation because in different containers or cartons, the labels must be positioned differently. Sometimes, however, as the articles to be labeled move near the labeling station, the label is applied to the articles. Label applicators of this type are shown, for example, in U.S. Pat. Nos. 4,725,327; 5,067,890; 5,198,247; and 5,266,149.

The use of a label reorienting apparatus to the processing system which can be done expeditiously and at high speeds has heretofore eluded the efforts of those in the industry.

SUMMARY OF THE INVENTION

Accordingly it is an object of the present invention to provide a label device which can apply labels at high speed to individual product units on a continuous flow basis.

It is an additional object of the present invention to provide such a device which can apply the label to the inside of the containers and at a speed that is commensurate with the processing speed.

It is a further object of the present invention to provide a method using this apparatus to label containers in the inside without slowing down the packaging operation.

It is a still further object of the present invention to provide a device which repositions the applicator head once the label is fed onto the vacuum grid.

It is an additional object of the present invention that this reorientation is done simultaneous with said applicator moving from label feed area to match speed with the container to be labeled and back again.

In accordance with these and other objects of the invention, an automatic labeling device is provided for applying the labels to product units. The device includes a conveyor for continuously conveying a series of identified product containers in which the product is to be sold.

The system or device for applying tags or labels on cartons consists of a commercially available labeling machine that is interfaced to a translation mechanism. The mechanism is mechanically linked and driven by the main line shaft of a cartoning machine. With this apparatus, tags or labels can be placed on a carton at relatively high speed. The system can include a barrel cam translation device that would provide movement along the "x" and "y" axis of the plane of travel of the cartons and labels. A rack and pinion gear coupling of the vacuum applicator to the applicator support enables the head to rotate as required. A stationary cam acting on the end of the rack provides the correct angular positioning of the applicator head. This device is integrated with a labeling machine such that a tag or label is dispensed to the applicator device is integrated with a labeling machine such that a tag or label is dispensed to the applicator vacuum grid on the applicator support which is mounted on the translation device. Since the translation device is mechanically linked to the carton, a predetermined motion can be executed that will permit the applicator head to leave the label feed area, accelerate to match the speed of the container, and position the applicator head at the same time.

The advantages of this method are the labeling machine is more efficiently mounted perpendicular to the flow of containers on a commercially available cartoning machine. This provides room for normal operator interaction in the labeling process.

Figure 1A:
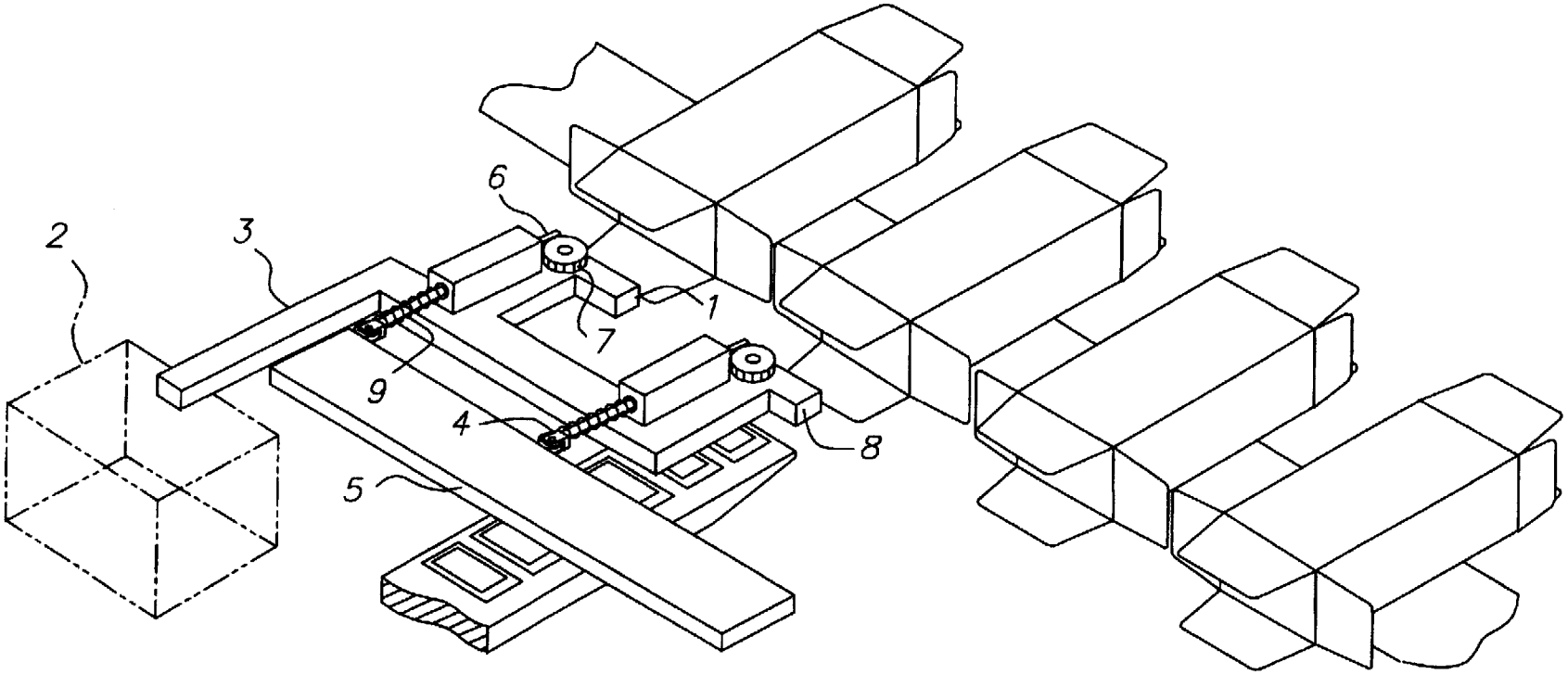
FIG. 1 describes the process of dispensing and applying labels to the inside of a carton.
Figure 1B:
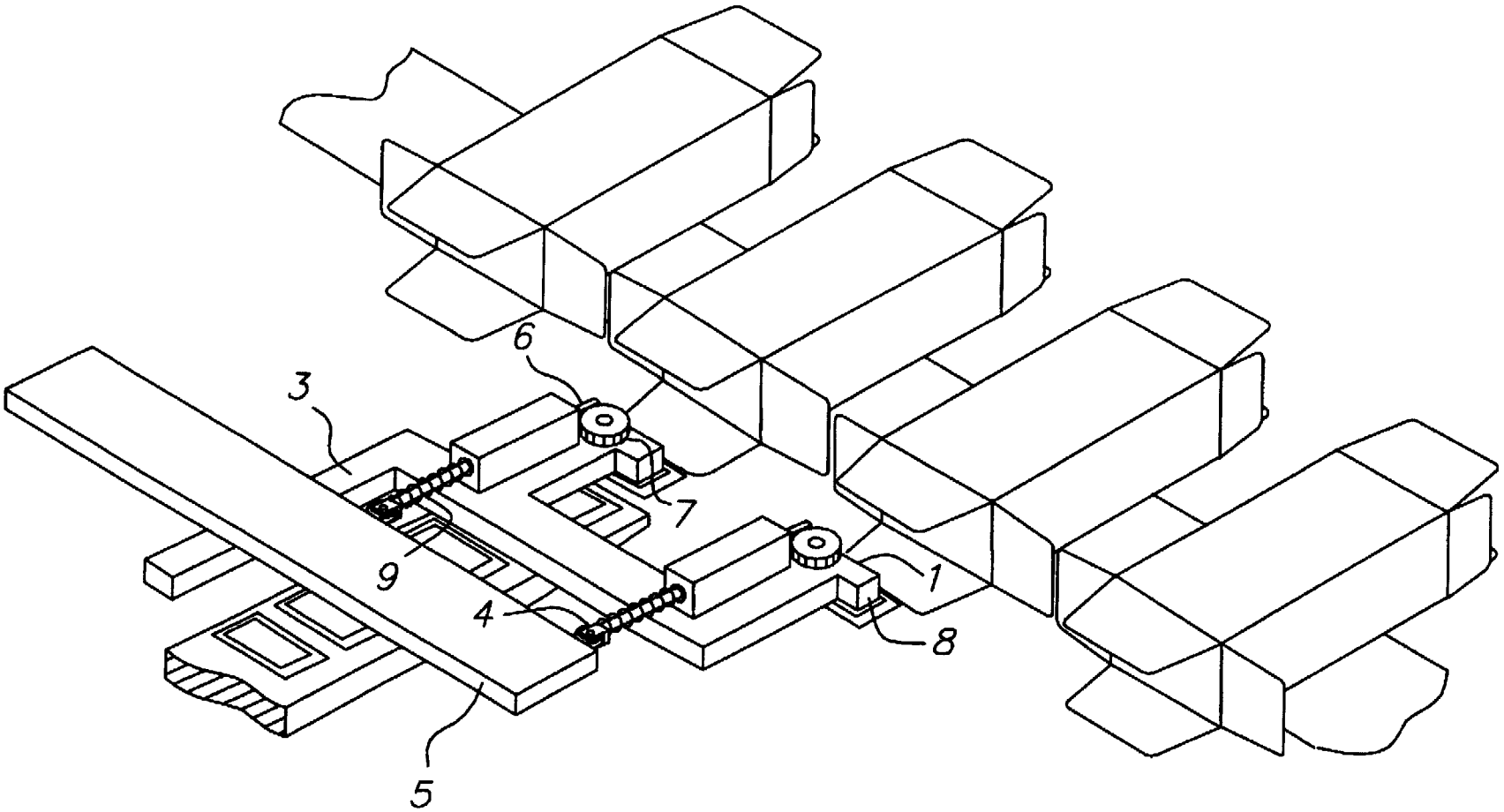
Figure 1C:
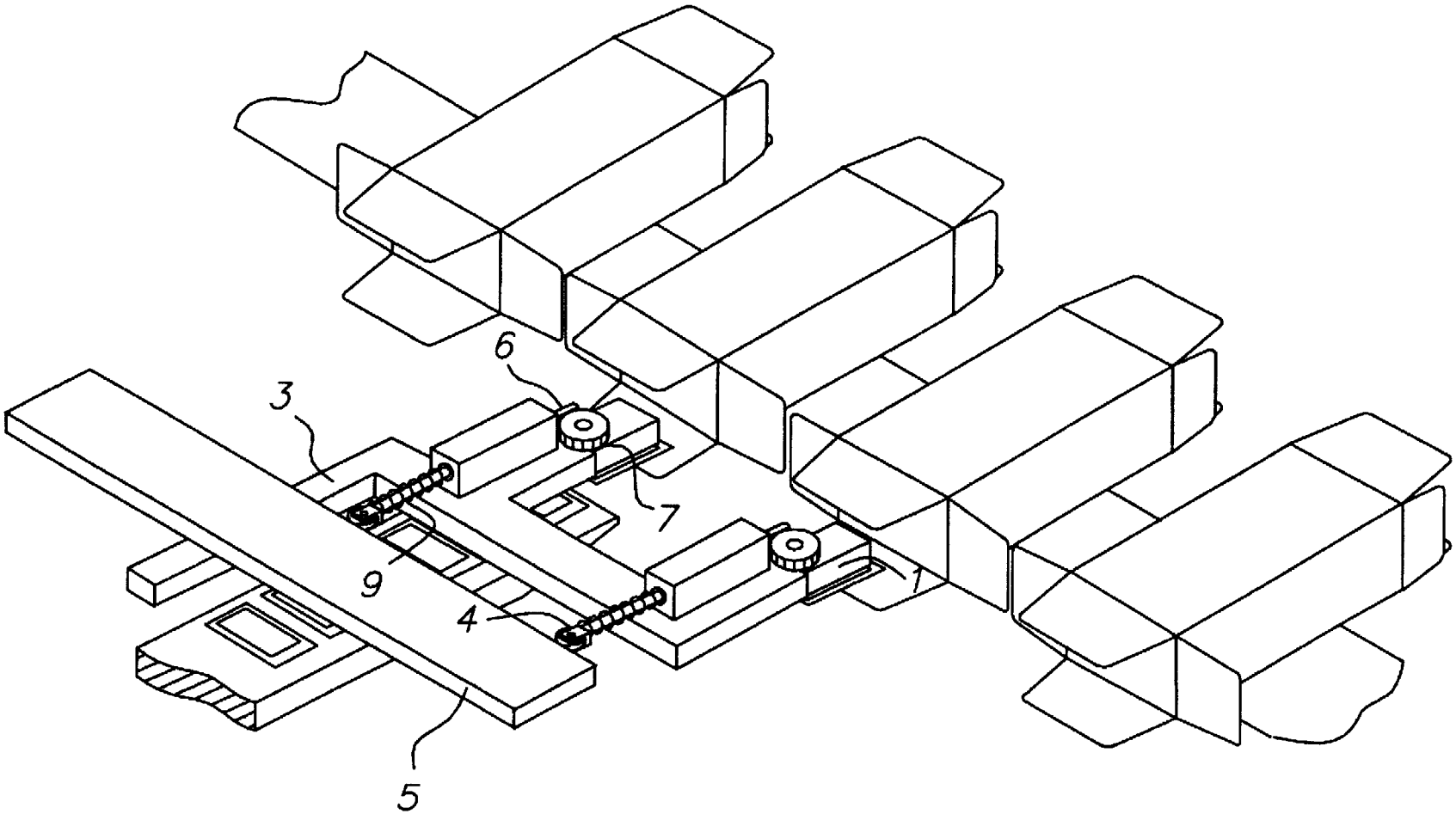
Figure 1D:
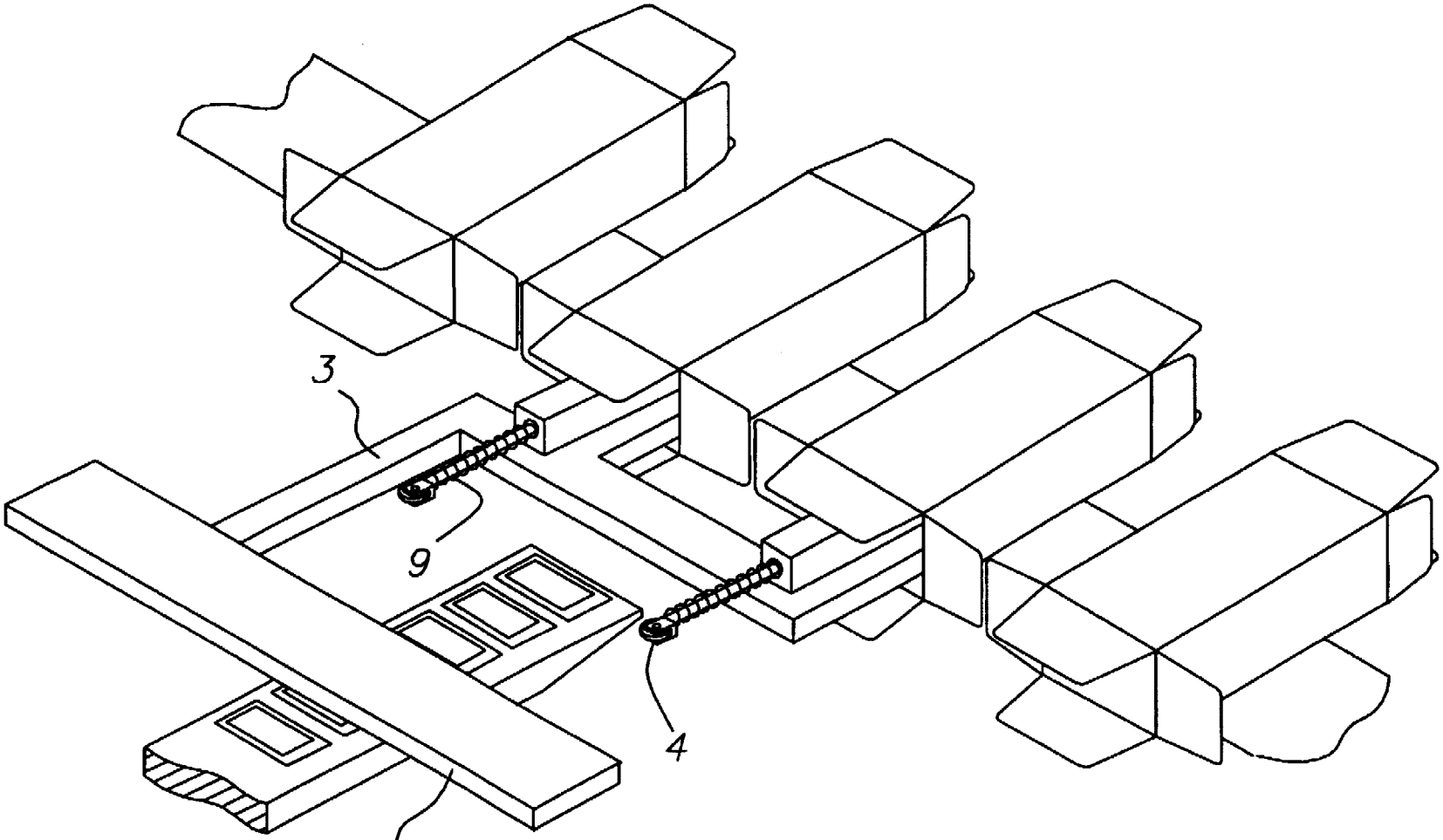
Figure 1E:
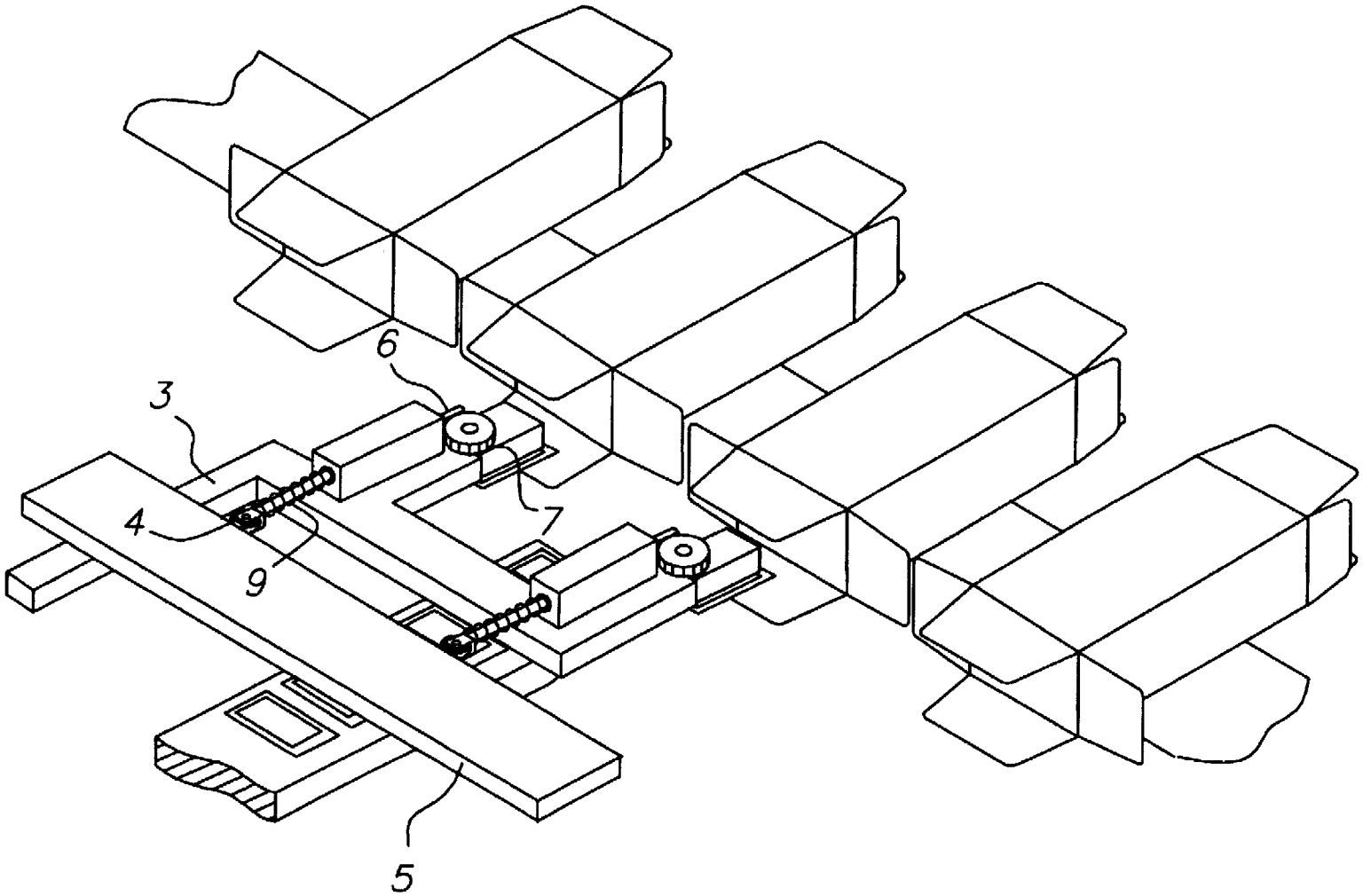
Figure 1F:
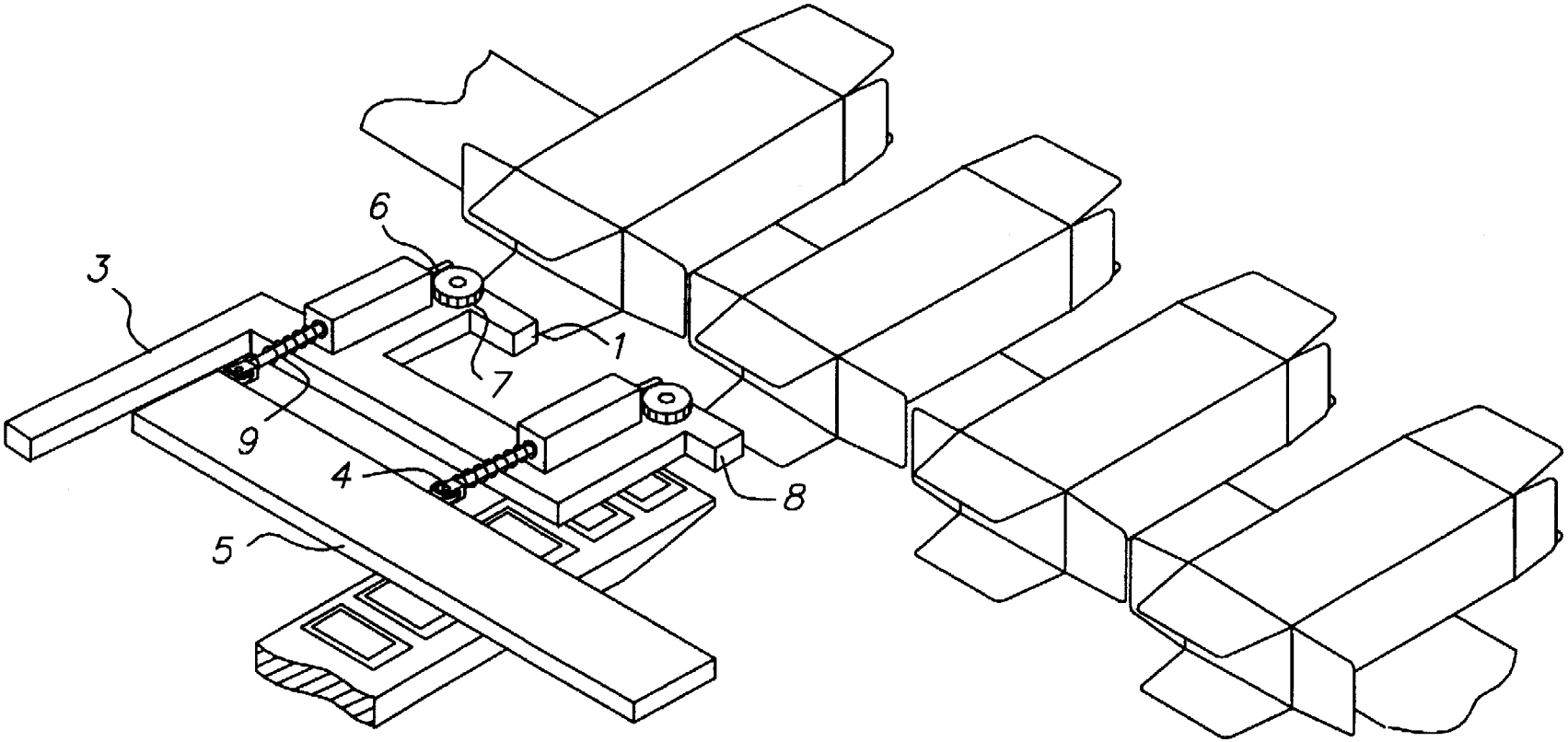

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

FIG. 1 shows the process of dispensing either one or a multiplicity (2 shown in FIG. 1 ) of labels to vacuum applicator heads. The labels are then repositioned and applied to the inside of cartons which are moving through a packaging process. The process of the present invention allows the insertion of the label inside the carton because the label was repositioned, thereby presenting the smaller side of the label to the opening in the carton. The other side would be too long to fit through the opening. The label application is accomplished without slowing down or stopping the process.

In FIG. 1, the process begins at "A" with the pickup of a label with vacuum head 1. At this point the translation device 2 moves vacuum head support 3 in the "X" direction to process point "B". During this travel the bearing 4 rides on a stationary cam 5. The bearings on the end of gear racks 6 lock the spur gears 7 which are mounted to the applicator head in a 0° orientation. This 0° location of the applicator heads is required to accept a label from the label feeder. At process point "B", a second label is picked up by applicator head 8. The translator then moves the vacuum head support in the "Y" direction toward the cartons and back along the "X" plane to match the speed of the cartons. At process point "C" the applicator support has moved sufficiently in the "Y" direction to cause a compression spring 9 to extend the rack gear. This causes the spur gear to rotate 90° in the counterclockwise direction until a stop collar on the rack limits any further rotation. At process point "D" the translator has moved the applicator support to its full "Y" travel. The applicator heads 1 and 2 are inside the carton and may apply the label. At this time the applicator support is matching the speed of the carton conveyor. The bearings are off the stationary cam. At process point "E" the applicator support has moved back in the "Y" direction and the bearings are again in contact with the stationary cam. Going from process point "E" to "F" the applicator support decelerated in the "X" direction and moves to the fully retracted position in the "Y" direction. The beatings are pressed against the stationary cam, compressing the spring and causing the rack gear to travel back to its position in process point "A". This turns the spur gear, which is mounted to the applicator head, 90° in the clockwise direction. The translator is now back to process point "A".

Figure 2:
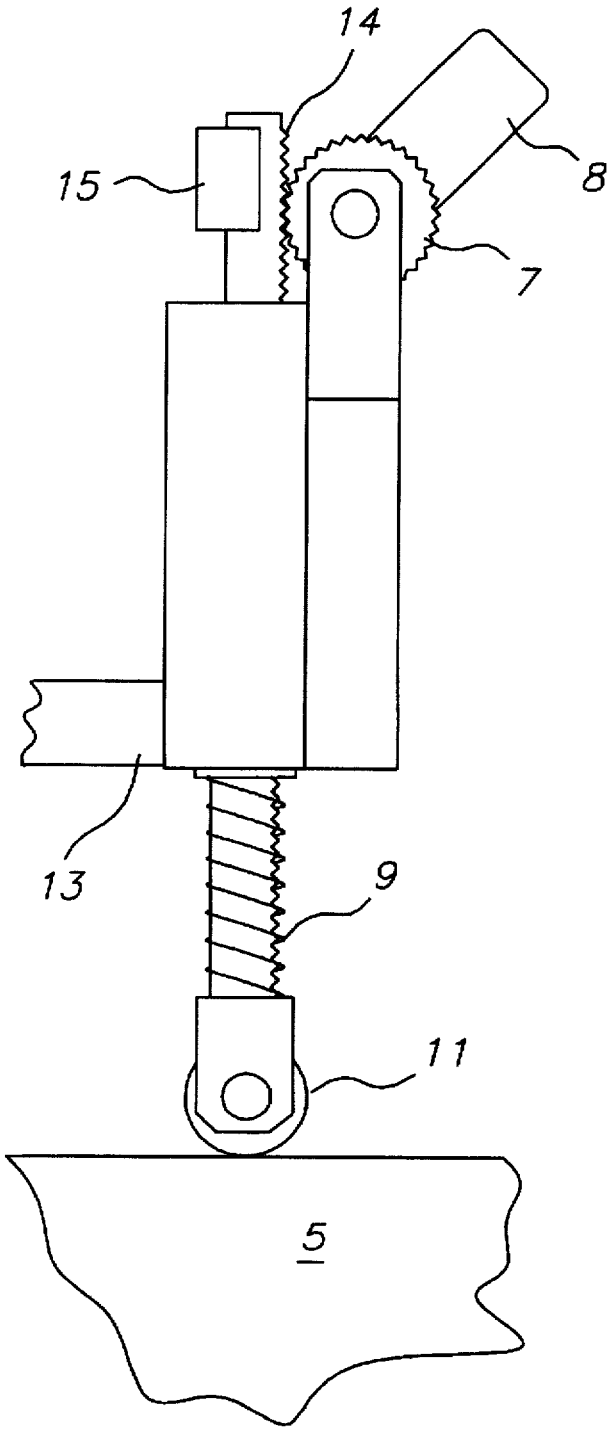
FIG. 2 illustrates the rack and pinion gear coupling including movement of vacuum grids relative to a stationary cam to provide positioning of the applicator heads.

FIG. 2 is an illustration of the rack and pinion gear, cam and bearing which allow the repositioned application of labels to the inside of cartons or containers. In FIG. 2 cam 10 is abutted to bearing 11 which is attached to compression spring 12. The spring is attached to applicator support 13 to which is attached rack gear 14 with a sleeve beating.

Movement of the applicator support upwards causes a separation between the cam and bearing. This allows the spring 12 to extend, thus moving the rack gear 14 down, which rotates the spring gear counterclockwise (CCW) The stop collar 15 limits the amount of travel.

Spur gear 16 to which the applicator head 17 is attached moves the applicator head from 0° to 90° in relation to the drive shaft.

As bearing 11 moves away from cam 10 and spring 12 extends, CCW rotation is achieved. As the cam moves against the beating, causing the spring to compress, clockwise (CW) rotation is achieved.

Movement of the applicator support downward causes the cam to push up against the bearing. The rack gear is then moved up compressing the spring and rotating the spur gear CW. Movement of the applicator support is stopped when the head returns to 0° position.

Figure 3:
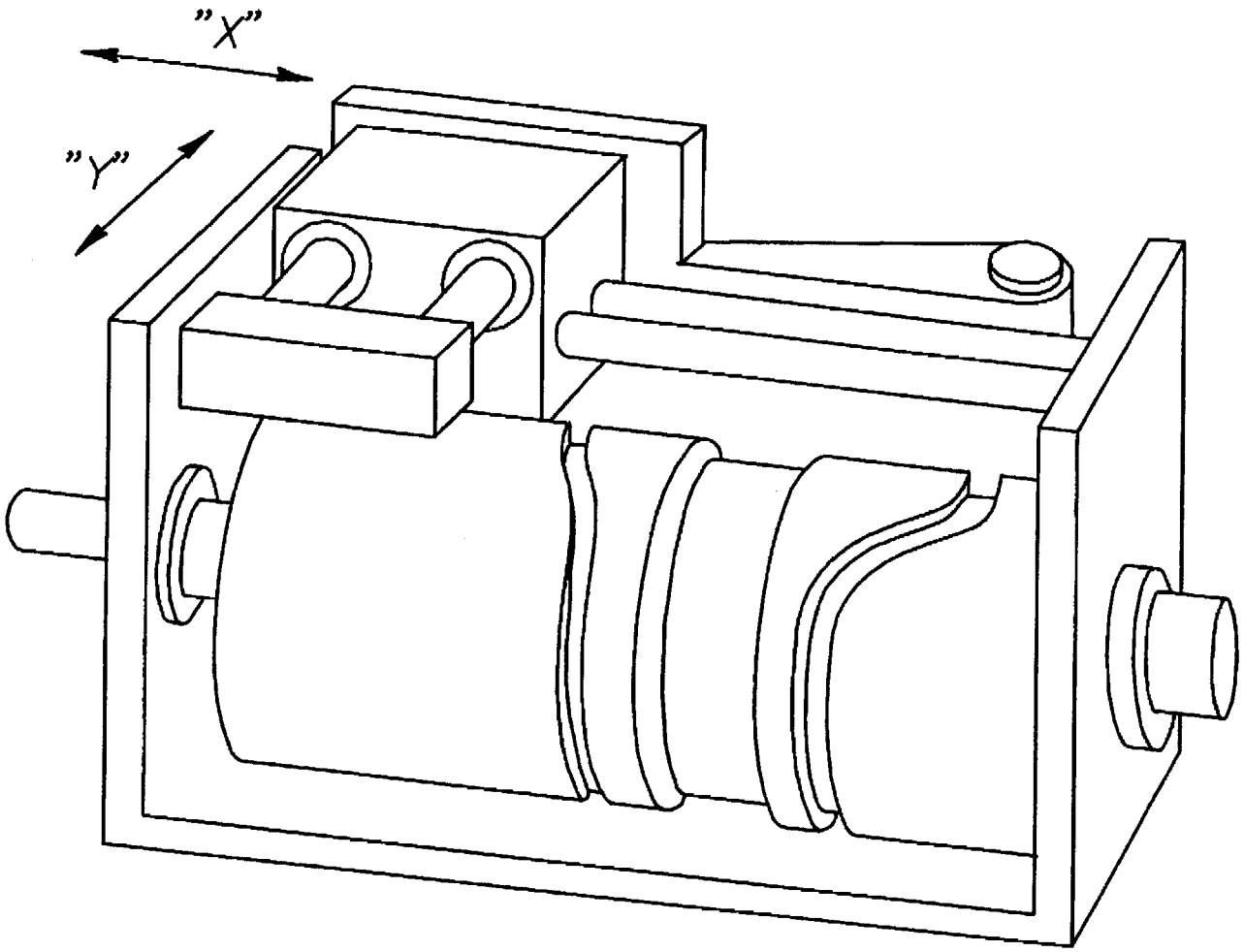
FIG. 3 shows a barrel cam translation device.

FIG. 3 shows a typical barrel cam translation device.

A novel feature of the apparatus is a cam such as a barrel cam translation device which is linked to a vacuum grid that provides movement along the x-y axis of the plane of travel of the cartons and labels. This device is integrated with a labeling machine such that the label is dispersed to a vacuum grid which is mounted on the translation device. Since the translation device is mechanically linked to the carton or container, a predetermined motion can be devised that permits the vacuum grids to enter the cartons and apply the labels.

While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

We claim:

1. Apparatus for applying labels to the inside of product containers being conveyed through a packaging process and for repositioning label applicator head before applying labels to the interior of said containers comprising:

a vacuum applicator head containing a support for the applicator head to which the applicator head is coupled;

a pivot mount which couples the vacuum applicator head and the vacuum applicator head support;

a spur gear which is fastened to the vacuum head, the teeth of which are meshed with a rack gear which is mounted on the applicator support;

a roller bearing mounted on the far end of the rack;

a compression spring located on the rack between a bearing housing and housing that supports the rack gear; and a stop collar attached to the far end of the rack.

2. The apparatus of claim 1 wherein the applicator contains a plurality of vacuum heads.

3. The apparatus of claim 2 wherein the vacuum heads contain means to blow labels onto the inside of cartons.

4. The apparatus of claim 1 containing a stationary cam on which the bearing rides when the applicator support is in its fully retracted position.

* * * * *

UNITED STATES PATENT AND TRADEMARK OFFICE

CERTIFICATE OF CORRECTION

PATENT NO. : 5,690,783
DATED : 25 November 1997
INVENTOR(S) : William J. Meyers, et al It is certified that error appears in the above-identified patent and that said Letters Patent is hereby corrected as shown below:

| | |
|---|---|
| column 4, lines 9-10 | -- In Fig. 2 cam 5 is abutted.... -- |
| column 4, line 11 | -- spring 9. -- |
| column 4, line 20 | -- Spur gear 7 to which the applicator head 8 is attached -- |
| column 4, line 24 | -- As bearing 11 moves away from cam 5 and spring 9 -- |

Signed and Sealed this

Twenty-fourth Day of February, 1998

*Attest:*

Bruce Lehman

BRUCE LEHMAN

*Attesting Officer*

*Commissioner of Patents and Trademarks*